United States Patent [19]

Goodwin

[11] Patent Number: 4,756,939

[45] Date of Patent: Jul. 12, 1988

[54] ABSORBENT PAD FOR USE IN PACKAGING FOOD PRODUCTS

[76] Inventor: Jerry L. Goodwin, 800 Scotland Ave., Rockingham, N.C. 28379

[21] Appl. No.: 81,357

[22] Filed: Aug. 4, 1987

[51] Int. Cl.[4] ..... B65D 81/26

[52] U.S. Cl. ..... 428/74; 206/204; 206/205; 428/76; 428/137; 428/138; 428/192

[58] Field of Search ..... 206/204, 205; 428/74, 428/76, 137, 138, 192

[56] References Cited

U.S. PATENT DOCUMENTS

| | | | |
|---|---|---|---|
| 4,382,507 | 5/1982 | Miller | 206/204 |
| 4,423,101 | 12/1983 | Willstead | 428/76 |
| 4,675,225 | 6/1987 | Cutler | 428/137 |

*Primary Examiner*—Marion C. McCamish
*Attorney, Agent, or Firm*—Shefte, Pinckney & Sawyer

[57] ABSTRACT

An absorbent pad adapted for placement in a package beneath a food product having a tendency to exude fluid. The pad comprises a mat of fluid absorbent material having two oppositely facing substantially flat surfaces with side portions, and a cover, made from a liquid impermeable material enclosing the mat, having two oppositely facing substantially flat imperforate surfaces, corresponding with the oppositely facing surfaces of the mat, and side portions corresponding with the side portions of the mat. At least two of the side portions of the cover have a plurality of perforations along their extent to permit passage of the exuded material through the cover for absorption by the mat.

7 Claims, 3 Drawing Sheets

ABSORBENT PAD FOR USE IN PACKAGING FOOD PRODUCTS

BACKGROUND OF THE INVENTION

The present invention relates to absorbent pads, and more particularly to absorbent pads for placement in a package beneath a food product having a tendency to exude fluid, such as meat, poultry and the like.

Conventional practice in the grocery industry is to display meat, poultry and other food products in individual transparent packages for inspection by customers. Therefore, it is highly desirable that the packaging and the food product present a pleasant appearance. To accomplish this objective, food products having a tendency to exude fluids are packaged with an absorbent pad to absorb this exuded fluid and prevent reverse migration of the fluid to the food product. This prevents any bacteria that may be associated with the fluid from contaminating the food product and causing discoloration of it. The pad further retains the fluid so that the overall packaging appearance is appealing. Since the package is discarded by the consumer after purchase, it is also desirable that the pad be inexpensive to produce.

Known prior art absorbent pad type packages for food products are disclosed in U.S. Pat. Nos. 4,382,507; 4,275,811; 4,410,578; 3,209,978; 3,206,209; and 4,321,997. These prior art patents have complicated constructions involving multiple layers or sheets of absorbent materials and liquid impermeable covers with perforations to pass the exuded fluid, resulting in higher production costs, and in most cases, these pad constructions also require an internal support structure to prevent the weight of the food product from forcing the fluid from the absorbent pad and back into contact with the food product. Additional prior art absorbent pads are disclosed in U.S. Pat. Nos. 3,814,101; 4,055,180; 3,292,135, which also involve complicated constructions requiring additional expense to produce, and they specifically disclose an application for use as diapers, incontinency pads, sanitary napkins and the like.

One objective of the present invention is to provide an absorbent pad that is fully capable of absorbing any fluids exuded from the meat product while protecting the meat product against reverse migration, and that includes a simplified construction which is capable of high speed automatic production and therefore relatively inexpensive to produce.

SUMMARY OF THE INVENTION

The present invention provides an absorbent pad adapted for placement in a package beneath a food product having a tendency to exude fluid, such as meat, poultry or similar product and to absorb the exuded fluid and prevent reverse migration thereof and any associated bacteria to the food product. The shelf life of the product is thereby prolonged as the food product does not soak or marinate in possible contaminants, and the product does not discolor as readily. Thus the entire appearance of the package and food product is more appealing to the consumer.

Briefly described, the pad of the present invention comprises a mat of fluid absorbent material, having two oppositely facing substantially flat surfaces with side portions therebetween, and a cover made from a liquid impermeable material enclosing the mat. The cover also has two oppositely facing substantially flat surfaces corresponding with the oppositely facing surfaces of the mat, and side portions joining the oppositely facing surfaces which correspond to the side portions of the mat. Preferably, the two oppositely facing substantially flat surfaces of the cover are both imperforate, and at least two of the side portions of the cover have a plurality of perforations along their extent to permit passage of the exuded material through the cover for absorption by the mat.

Preferably, the mat of fluid absorbent material comprises an essentially flat portion of a wood pulp product commonly known as wood fluff with a single, thin carrier sheet of paper, similar to facial tissue, commonly known as paper wadding, being folded about the portion of wood fluff to retain the wood fluff intact during manufacturing of the absorbent pad and to prevent particles of wood fluff from passing through the perforations and contaminating the food product when the pad is in use.

In the preferred embodiment of the present invention, the cover enclosing the mat of absorbent material is formed from a single length of liquid impermeable material having two opposite endwise edges and two opposite side edges. The length of material is folded upon itself along opposite fold lines which are parallel to the endwise edges of the length of material. When the length is folded, the endwise edges lying adjacent one another are joined together, and the two opposite side edges are sealed to form an enclosure with the mat of fluid absorbent material disposed internally thereof.

The plurality of perforations in the cover of the preferred embodiment are located adjacent to, and on both sides of, the fold lines such that the area of the cover having the perforations therein corresponds generally to the area of the side portions extending between the oppositely facing substantially flat surfaces of the cover.

DESCRIPTION OF THE PREFERRED EMBODIMENT

Figure 1:
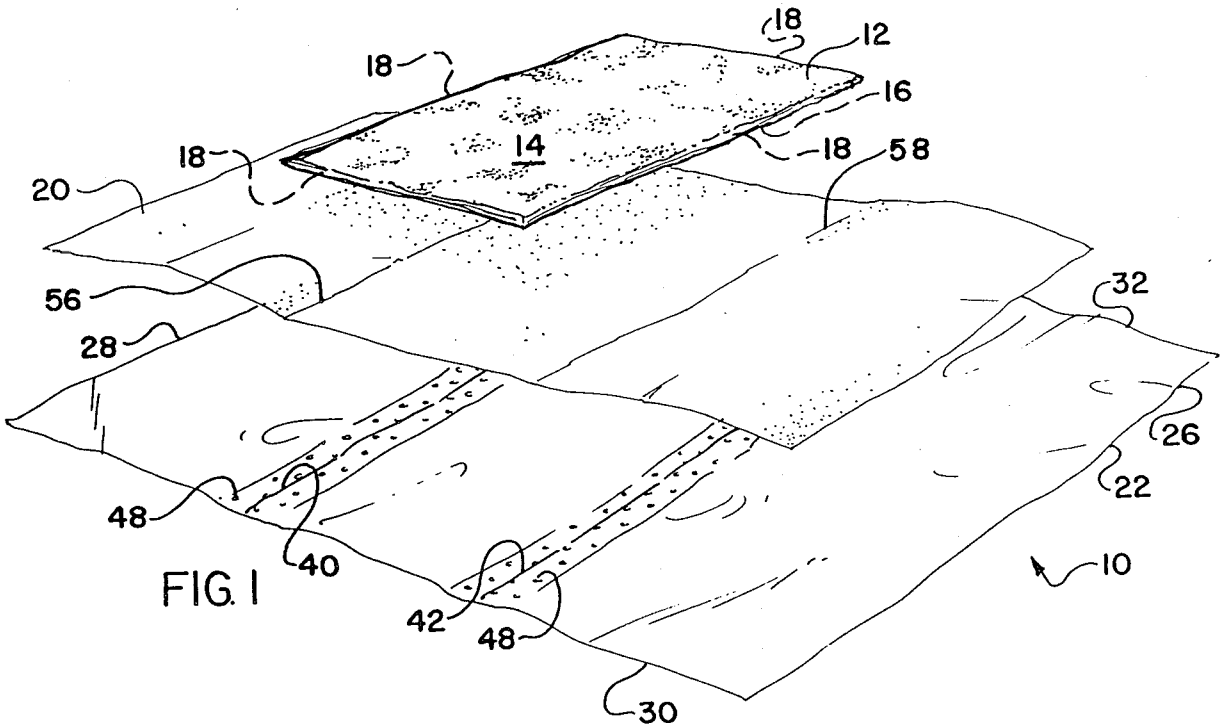
FIG. 1 is an exploded perspective view of the absorbent pad according to the preferred embodiment of the present invention.
Figure 2:
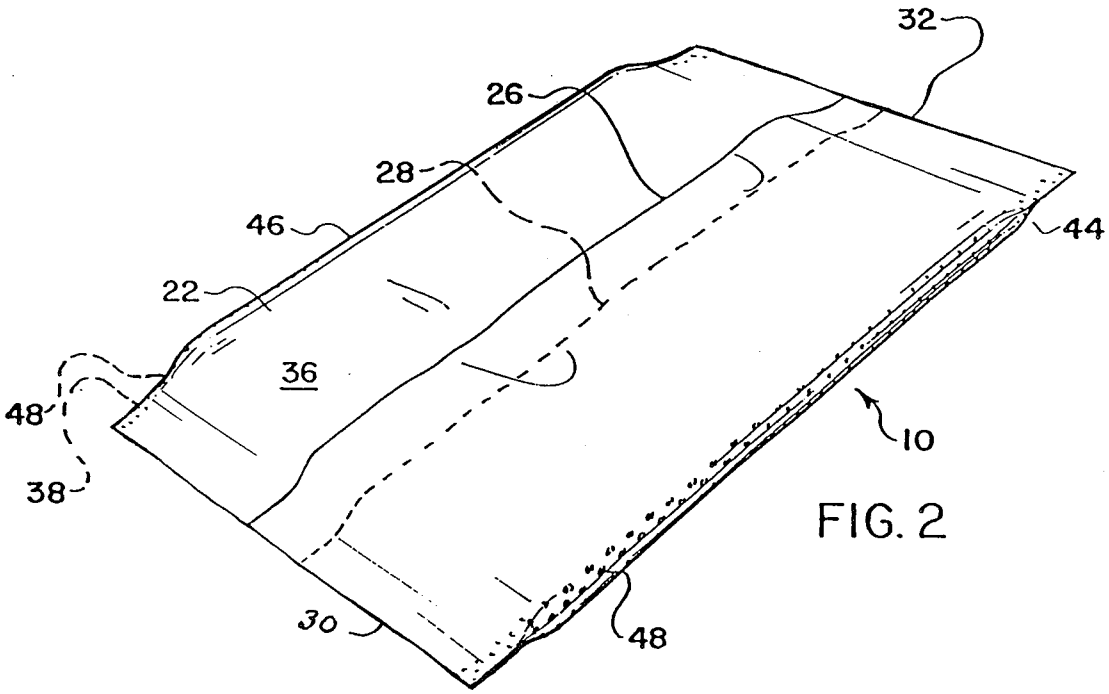
FIG. 2 is a perspective view of the absorbent pad according to the preferred embodiment of the present invention.

Referring now to the accompanying drawings, the absorbent pad of the present invention is indicated generally at 10 in FIGS. 1 and 2 and includes a flat mat 12 of fluid absorbent material having two oppositely facing substantially flat surfaces 14,16 and side portions 18 between the surfaces 14,16.

The mat 12 of fluid absorbent material of the preferred embodiment of the present invention is essentially a flat portion of a wood pulp product commonly known as wood fluff. As best seen in FIG. 1, a single, thin, substantially rectangularly shaped carrier sheet 20 of paper, similar to facial tissue, commonly known as paper wadding, is folded about the wood fluff mat 12 to retain the mat 12 intact during the manufacturing of the absorbent pad 10.

The mat 12 and sheet 20 are enclosed within a cover 22 made form a liquid impermeable material such as polyethylene. The cover 22 has two oppositely facing substantially flat imperforate surfaces 36,38 corresponding with the oppositely facing surfaces 14,16 of the mat 12, and side portions 44,46 joining the imperforate surfaces 36,38 which correspond with the side portions 18 of the mat 12. In the preferred embodiment at least two of the side portions 44,46 of the cover 22 have a plurality of perforations 48 along their extent to permit passage of the fluid exuded from the food product through the cover 22 for absorption by the mat 12.

Referring to FIG. 1, it will be seen that the cover 22 enclosing the mat 12 is formed from a substantially rectangularly shaped length of liquid impermeable material such as polyethylene, having two opposite endwise edges 26,28 and two opposite side edges 30,32. The rectangularly shaped length of material is folded upon itself along opposite fold lines 40,42 which are parallel to the endwise edges 26,28. When folded, as illustrated in FIG. 2, the endwise edges 26,28 lie adjacent one another and are joined together by an adhesive or other suitable means, and the two opposite side edges 30,32 are sealed, such as by heat sealing, to form an enclosure as illustrated in FIG. 2 with the wood fluff mat 12 and the carrier sheet 20 of paper wadding folded about the mat 12 being disposed within.

Referring to FIG. 2, only the area of the cover 22 corresponding generally to the areas of the side portions 44,46 contain perforations 48 therein to permit passage of the exuded fluid through the cover 22 for absorption by the mat 12. As best illustrated in FIG. 1, the plurality of perforations 48 is located adjacent to, and on both sides of the fold lines 42,44. The substantially rectangularly shaped carrier sheet 20 of paper wadding as shown in FIG. 1 is folded about the mat 12 along fold lines 56,58, corresponding generally to the fold lines 42,44 of the cover 22 such that when the pad 10 is formed, the carrier sheet 20 prevents particles of the wood fluff mat 12 from passing through the perforations 48 and contaminating the food product when the pad 10 is in use.

Figure 3:
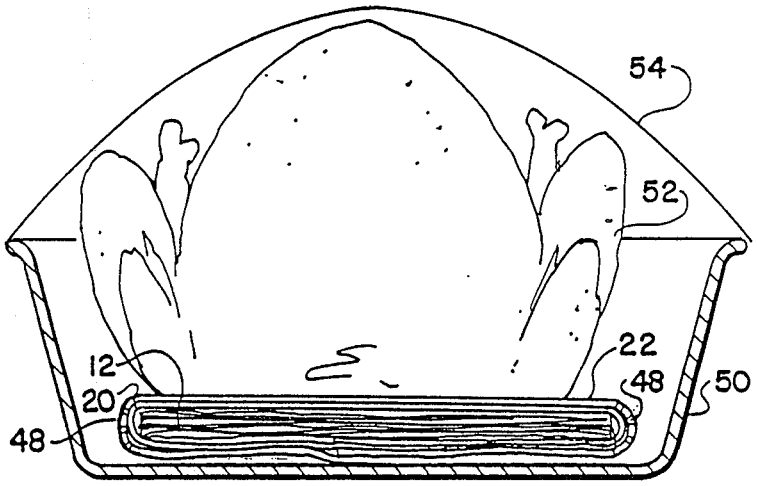
FIG. 3 is a side elevation view, partly in section, illustrating the absorbent pad of the present invention in use within a package for poultry, the dimensions of this drawing being exaggerated in some cases for clarity of illustration.

FIG. 3 illustrates one typical use of the absorbent pad 10 of the present invention wherein it is disposed at the bottom of a conventional tray 50 with an item of poultry 52 resting on top of the pad 10 and having a clear plastic cover 54 extending over the poultry product 52 and attached to the tray 50 to contain the poultry product 52 while still permitting customers to have a full view of the poultry product. It will be noted that the poultry product 52 rests on the pad 10 in direct contact with an imperforate side portion of the pad 10 so that the poultry product 52 is protected against reverse migration of fluids through the cover 22 of the pad 10. Fluids exuded by the poultry product 52 will tend to flow away therefrom toward the bottom of the tray 50 and will, to some extent, pass to the spacing between the side walls of the tray 50 and the pad 10 where such fluids are permitted to flow freely into the confines of the cover 22 through the perforations 48 in the side portions 44 for absorption by the mat 12.

In known absorbent pads having perforations formed throughout the bottom surface only of the cover (see, e.g., U.S. Pat. No. 4,382,507), the weight of the packaged product acts downwardly against the pad so that the perforated bottom surface thereof is pressed against the bottom surface of the tray, and this force may be sufficient to cause many, if not most, of the perforations to be closed by the surface of the tray, whereby the fluids exuded by the packaged product do not flow into the pad through such perforations for absorption. This problem is exacerbated when the packaged products are stacked on top of one another so that a greater pressing force is imposed on the lower units in the stack.

By virtue of the construction of the absorbent pad 10 of the present invention, the aforesaid problem is substantially eliminated because the perforations 48 are located only in the side portions 44,46 where they are not affected by the weight of the packaged product. Moreover, because there is usually some spacing between such side portions 44,46 and the adjacent walls of the tray 50, the fluids may tend to puddle in such spacing where they can be quickly absorbed within the mat 12 by passing through the perforations 48.

In conventional absorbent pads, the pad is usually formed by sandwiching the absorbent pad between two rectangular sheets of plastic, and then sealing all four edges of the two sheets to provide an enclosure for the absorbent mat. Because the four side edges of the cover are sealed, usually by heat sealing, it would not be feasible to form perforations in such side edges of the cover and obtain the advantage of the present invention. This problem is overcome by the present invention by virtue of the fact that the cover 22 is formed from one length of material that is folded upon itself, as described above, to leave two side portions 40 and 42 that can be readily perforated.

Thus, the absorbent pad 10 of the present invention represents a significant advance in the art by providing a pad that will protect the packaged product while encouraging rapid absorption of fluids exuded by such product, even when the weight of the product is relatively heavy. Also, the simplicity and economy of the construction of the absorbent pad 10 of the present invention will thus be readily discerned. The pad 10 can be inexpensively produced utilizing a minimum of material and a minimum of steps for construction making the pad highly adaptable to high speed mechanized production.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. An absorbent pad adapted for placement in a package beneath a food product having a tendency to exude fluid, such as meat, poultry and the like, to absorb said fluid and prevent reverse migration of said fluid and any associated bacteria to the food product, said pad comprising a mat of fluid absorbent material having two oppositely facing substantially flat surfaces with side portions therebetween and a cover made from a liquid impermeable material enclosing said mat, said cover having two oppositely facing substantially flat imperforate surfaces, corresponding with said oppositely facing surfaces of said mat, and side portions joining said imperforate surfaces, corresponding with said side portions of said mat, with at least one of said side portions of said cover having a plurality of perforations along their extent to permit passage of said exuded material through said cover for absorption by said mat.

2. A pad according to claim 1 and characterized further in that said perforations are formed in two opposite side portions of said cover.

3. A pad according to claim 1 and characterized further in that said mat of fluid absorbent material comprises an essentially flat portion of wood fluff having two oppositely facing surfaces with side edges therebetween and a carrier sheet of paper wadding folded about said portion of wood fluff to retain said wood fluff intact during manufacture and to prevent particles of wood fluff from passing through said perforations and contaminating the food product when said pad is in use.

4. A pad according to claim 1 and characterized further in that said cover enclosing said mat is formed from a length of liquid impermeable material having two opposite endwise edges and two opposite side edges, said length being folded upon itself along opposite fold lines parallel to said endwise edges of said length of material, with said endwise edges lying adjacent one another and being joined together, and with said two opposite side edges of said folded overlapping material being sealed to form an enclosure.

5. A pad according to claim 4 and characterized further in that said plurality of perforations are located adjacent to, and on both sides of, said fold lines.

6. A pad according to claim 5 and characterized further in that the areas of said cover having said perforations therein correspond generally to the areas of the side portions extending between said oppositely facing flat surface.

7. An absorbent pad adapted for placement in a package beneath a food product having a tendency to exude fluid, such as meat, poultry, and the like, to absorb said fluid and prevent reverse migration of said fluid and any associated bacteria to said food product, said pad comprising:

a mat of wood fluff having two oppositely facing substantially flat surfaces with side portions therebetween and a carrier sheet of paper wadding folded about said mat to retain said mat intact during manufacture and to prevent wood fluff from contaminating said food product during use, and a cover enclosing said mat formed from a substantially rectangularly shaped length of liquid impermeable material having two opposite endwise edges and two opposite side edges, said rectangularly shaped length of material being folded upon itself along opposite fold lines parallel to said endwise edges, with said endwise edges lying adjacent one another and being joined together, and with said two opposite side edges being sealed to form an enclosure, said cover having two oppositely facing substantially flat imperforate surfaces, corresponding with said oppositely facing surfaces of said mat, and side portions corresponding in location to said fold lines, extending between said imperforate surfaces, the area of said cover corresponding generaly to the areas of said side portions having a plurality of perforations therein, said plurality of perforations being located adjacent to, and on both sides of, said fold lines to permit passage of said exuded fluid through said cover for absorption by said mat.

* * * * *